US005525028A

United States Patent [19]

Ogasawara et al.

[11] Patent Number: 5,525,028

[45] Date of Patent: Jun. 11, 1996

[54] OFFSET BOOM TYPE CONSTRUCTION MACHINE

[75] Inventors: Manabu Ogasawara; Toshio Hasegawa, both of Ibaraki-ken, Japan

[73] Assignee: Hitachi Construction Machinery Co., Ltd., Tokyo, Japan

[21] Appl. No.: 336,245

[22] Filed: Nov. 7, 1994

Related U.S. Application Data

[63] Continuation of Ser. No. 910,323, filed as PCT/JP91/01668, Nov. 28, 1991 published as WO92/09754, Jun. 11, 1992, abandoned.

[30] Foreign Application Priority Data

Nov. 30, 1990 [JP] Japan ..... 2-333601

[51] Int. Cl.[6] ..... E02F 9/24

[52] U.S. Cl. ..... 414/694; 414/728

[58] Field of Search ..... 414/687, 690, 414/694, 695.5, 718, 728; 901/12, 15

[56] References Cited

U.S. PATENT DOCUMENTS 3,149,737 9/1964 Guinot ..... 414/694
3,717,269 2/1973 Schaeff ..... 414/694

FOREIGN PATENT DOCUMENTS 57-174562 4/1982 Japan .
60-87248 6/1985 Japan .
62-7453 1/1987 Japan .
63-61465 4/1988 Japan .
2-37953 3/1990 Japan .
2-120427 5/1990 Japan .

*Primary Examiner* Donald W. Underwood
*Attorney, Agent, or Firm* Fay, Sharpe, Beall, Fagan, Minnich & McKee

[57] ABSTRACT

On the lower surface of a cylinder stay at its fore end portion, a stopper plate is pivotally attached as a safety device for front working equipment by a pin. A rear end portion of the stopper plate is supported to an upper boom to be swung in union with the upper boom. The stopper plate has an outer peripheral configuration having a first curved region which functions as a first stopper, and a second linear region which functions as a second stopper. When a swing angle of the upper boom is within a risky range of possible interference between the bucket and the cab upon the arm being maximally folded, an inner belly portion of the arm strikes against the first region before the occurrence of such interference, whereby further folding of the arm is mechanically limited. When the arm is folded from a condition that the swing angle of the upper boom is within a range in which the bucket and the cab will never interfere with each other and a folding angle of the arm comes within a risky range of possible interference between the bucket and the cab upon the upper boom being further swung laterally toward the cab side, the second region strikes against a side portion of the arm before the occurrence of such interference, whereby further swing of the upper boom is mechanically limited.

13 Claims, 9 Drawing Sheets

OFFSET BOOM TYPE CONSTRUCTION MACHINE

This is a continuation application of Ser. No. 07/910,323, filed as PCT/JP91/01668, Nov. 29, 1991, published as WO92/09754, Jun. 11, 1992, now abandoned.

TECHNICAL FIELD

The present invention relates to an offset boom type construction machine, and more particularly to an offset boom type construction machine which has an offset boom capable of offsetting in a lateral direction, and which is suitable for carrying out such work as digging side trenches, etc.

BACKGROUND ART

As disclosed in JP, U, 57-174562, for example, an offset boom type construction machine is arranged such that a lower boom is attached to a body of the construction machine for a vertical pivotal movement, an upper boom is attached to a fore end of the lower boom for a lateral pivotal movement, and a cylinder stay is attached to a fore end of the upper boom for a lateral pivotal movement. The construction machine also comprises an offset boom which is capable of offsetting upon a lateral swing of the upper boom, an arm attached to the offset boom via the cylinder stay for a vertical pivotal movement, and a working attachment such as a bucket attached to a fore end of the arm. A cab is provided on the machine body laterally of the lower boom.

In that offset boom type construction machine, when the arm is folded while the offset boom is offset toward the cab side, or when the offset boom is made offset toward the cab side while the arm is maximally folded, there is a risk that the bucket may interfere with the cab. A safety device is, therefore, required to prevent the interference between the bucket and the cab.

Conventional safety devices for that purpose are divided into mechanical ones and electro-hydraulic ones. As disclosed in JP, U, 2-37953, one of the known mechanical safety devices comprises a stopper in the form of a long plate having an elongate hole bored in one end and a pin hole bored in the other end, the stopper being attached to and along an offset cylinder by the use of joint pins at both ends of the offset cylinder. With this structure, when the offset cylinder is extended and contracted, the upper boom is swung laterally and, simultaneously, the joint pin is moved along the elongate hole. The sizes of the stopper and the elongate hole are selected to prevent the upper boom from approaching the cab side beyond a certain angle, whereby the bucket is kept from entering a risky range of possible interference with the cab.

However, since the above prior art is constructed to impede a lateral swing of the upper boom under a restriction imposed by the stopper, the upper boom can be in no way swung to the same side as the cab. In an attempt to perform work while offsetting the offset boom to the same side as the cab, the stopper must be removed before starting the work. The removal of the stopper means disassembly of the safety device; hence the safety device can no longer operate. Accordingly, the work is quite dangerous.

It is an object of the present invention to provide an offset boom type construction machine with which an offset boom can be offset toward the cab side and a working attachment can be prevented from interfering with a cab.

DISCLOSURE OF THE INVENTION

To achieve the above object, in accordance with the present invention, there is provided safety means including first stopper means attached to be moved in union with an upper boom, and arranged such that when an offset position of an offset boom is within a range of possible interference between a working attachment and a cab upon an arm being maximally folded, the first stopper means strikes against the arm before the occurrence of such interference, whereby further folding of the arm is mechanically limited. With this arrangement, when the arm is folded while the offset boom is offset toward the cab side, the working attachment can be prevented from interfering with the cab.

Preferably, the safety means further includes second stopper means arranged such that when a folded position of the arm is within a range of possible interference between the working attachment and the cab upon the upper boom being swung laterally toward the cab, the second stopper means mechanically restricts relative rotation between the cylinder stay and the upper boom before the occurrence of such interference, thereby limiting a further swing of the upper boom toward the cab in a mechanical manner. With this arrangement, when the upper boom is swung toward the cab while the arm is maximally folded, the working attachment can be prevented from hitting on the cab.

Preferably, the first and second stopper means have a common stopper plate attached for movement in union with the upper boom, and the stopper plate has an outer peripheral configuration including a first region positioned to strike against an inner belly portion of the arm when the arm is folded, and a second region positioned to strike against a side portion of the arm when the upper boom is swung toward the cab while the arm is folded, the first region of the stopper plate serving as the first stopper means, and the second region of the stopper plate serving as the second stopper means. The stopper plate is preferably attached to a lower surface of the cylinder stay rotatably in response to a swing of the upper boom.

Preferably also, the first stopper means has a stopper plate attached for movement in union with the upper boom, and first rolling means provided on one of the stopper plate and the inner belly portion of the arm and being capable of rolling in response to lateral relative movement between the upper boom and the arm so that further folding of the arm is limited. With this arrangement, when the upper boom is swung laterally while the first rolling means is kept abutted against the inner belly portion of the arm or the stopper plate, the first rolling means is caused to roll along the inner belly portion of the arm or the stopper plate. Therefore, the mutually abutting portions develop little friction between them, wear off to a quite small extent, and thus will not be scraped off, resulting in prolonged service life and smooth operation.

Preferably further, the first and second stopper means have a common stopper plate attached for movement in union with the upper boom, first rolling means provided on one of the stopper plate and the inner belly portion of the arm and being capable of rolling in response to lateral relative movement between the upper boom and the arm so that further folding of the arm is limited, and second rolling means provided on one of the stopper plate and the side portion of the arm and being capable of rolling in response to back-and-forth relative movement between the upper boom and the arm so that further swing of the upper boom is limited.

With this arrangement, in addition to the above operation of the first rolling means, the second rolling means operates as follows. When the arm is swung back and forth while the second rolling means is kept abutted against the side portion of the arm or the stopper plate, the second rolling means is caused to roll along the side portion of the arm or the stopper plate. Therefore, the mutually abutting portions also develop little friction between them, wear off to a quite small extent, and thus will not be scraped off, resulting in prolonged service life and smooth operation.

In the above case, the first and second rolling means may have a common rolling member. The first and second rolling means may be provided on the stopper plate. In this case, preferably, a boundary corner between the inner belly portion and the side portion of the arm against which the first and second rolling means are abutted is chamfered or formed into a curved surface. With this arrangement, when the stopper means is moved with respect to the boundary corner between the inner belly portion and the side portion of the arm, the first or second rolling member rides over the boundary corner between the inner belly portion and the side portion of the arm, for example, while continuing the rolling. This results in less wear of the corner and smooth operation.

Further, the first and second rolling means may be provided on the inner belly portion and the side portion of the arm, respectively.

While the first and second stopper means are preferably arranged to directly abut against the arm, the mutual abutment therebetween may be effected via an auxiliary member such as a link. For example, the first and second stopper means may also have a link interposed between the common stopper plate and the arm and pivotally connected to the cylinder stay, the first region of the stopper plate may strike against the inner belly portion of the arm through the link when the arm is folded, and the second region of the stopper plate may strike against a lateral surface of the link when the upper boom is swung toward the cab while the arm is folded.

BEST MODE OF CARRYING OUT THE INVENTION

Hereinafter, a first embodiment of the present invention will be described with reference to FIGS. 1 to FIGS. 4(A) and 4(B).

Figure 1:
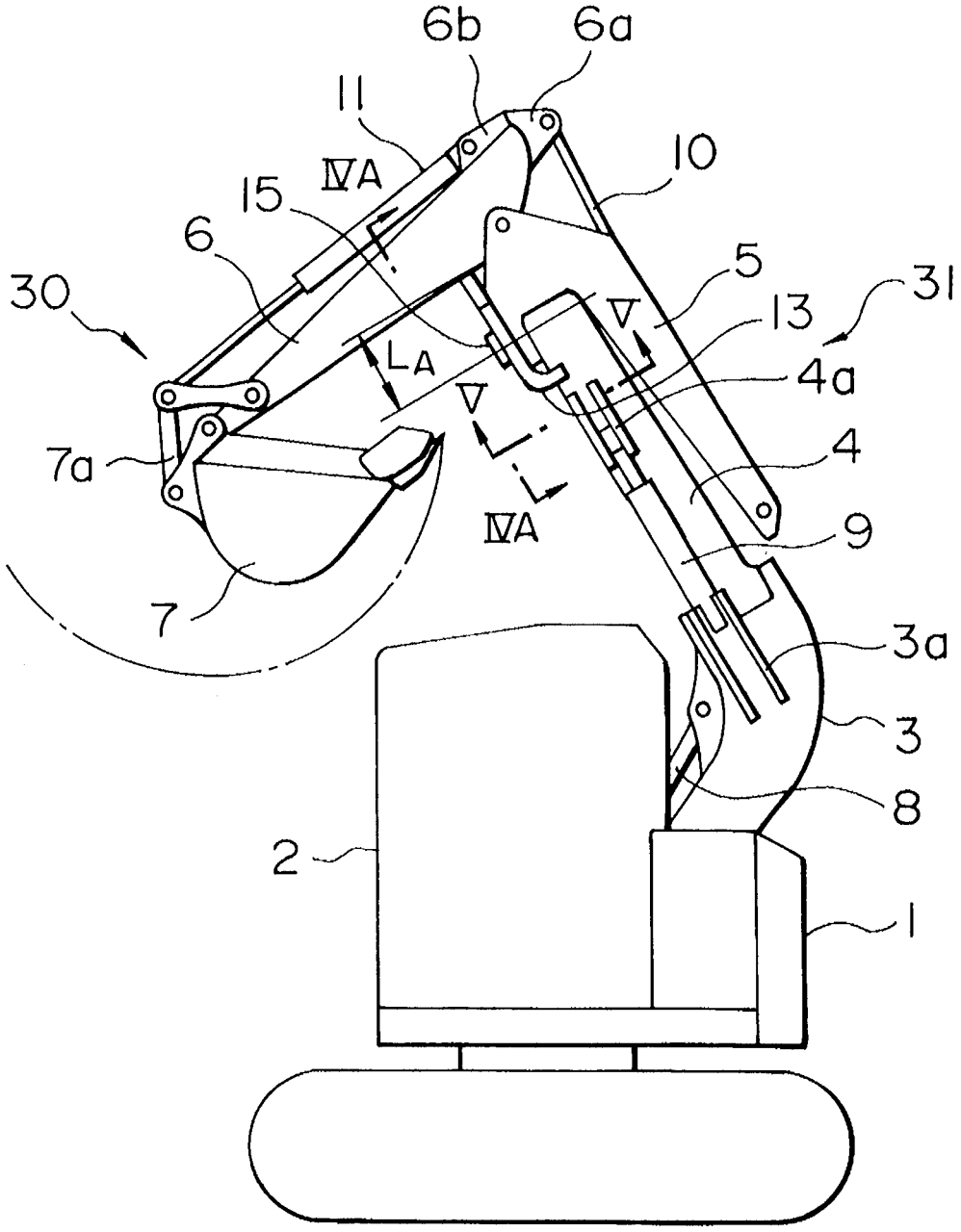
FIG. 1 is a side view of an offset boom type construction machine according to a first embodiment of the present invention.
Figure 2:
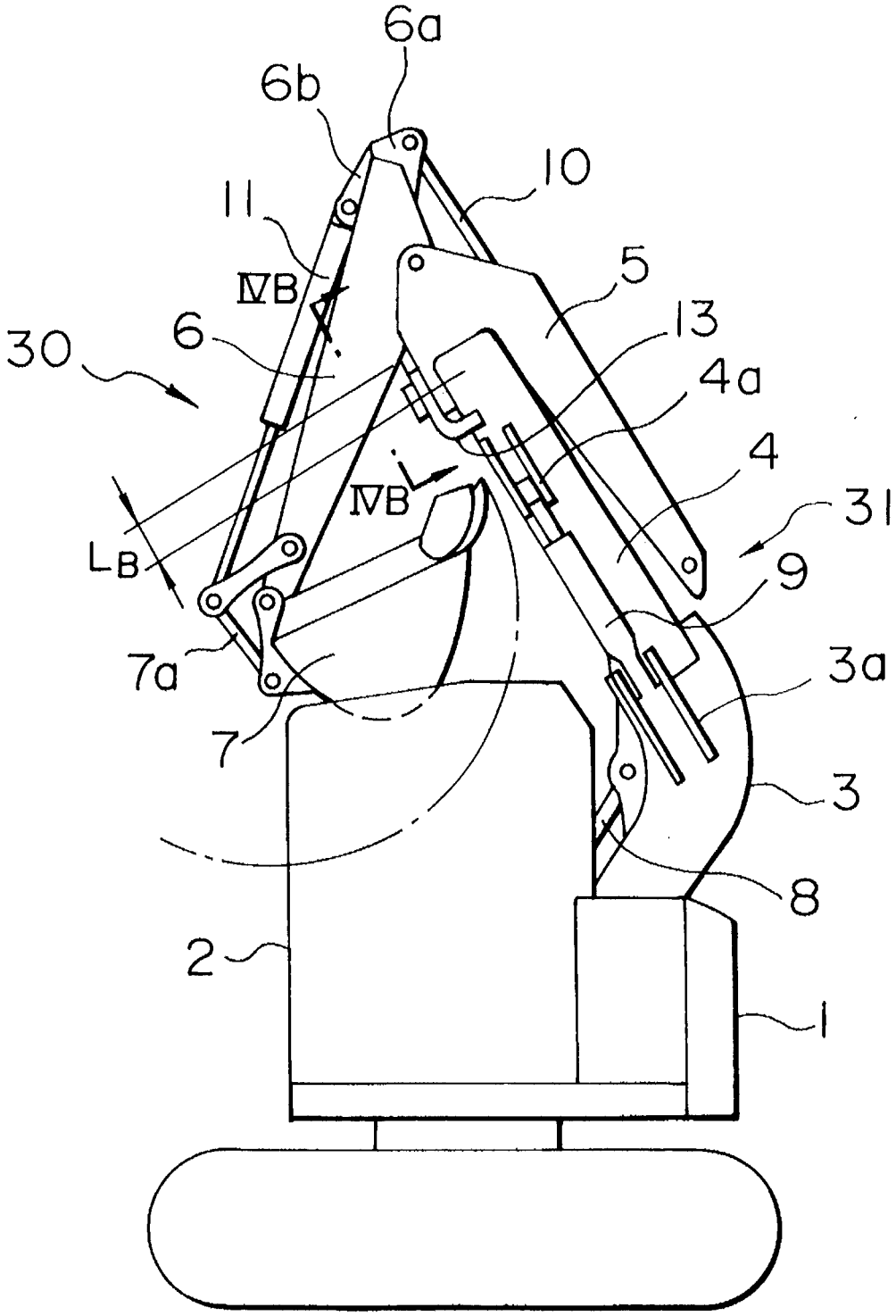
FIG. 2 is a side view showing a different operating state of the offset boom type construction machine shown in FIG. 1.
Figure 3:
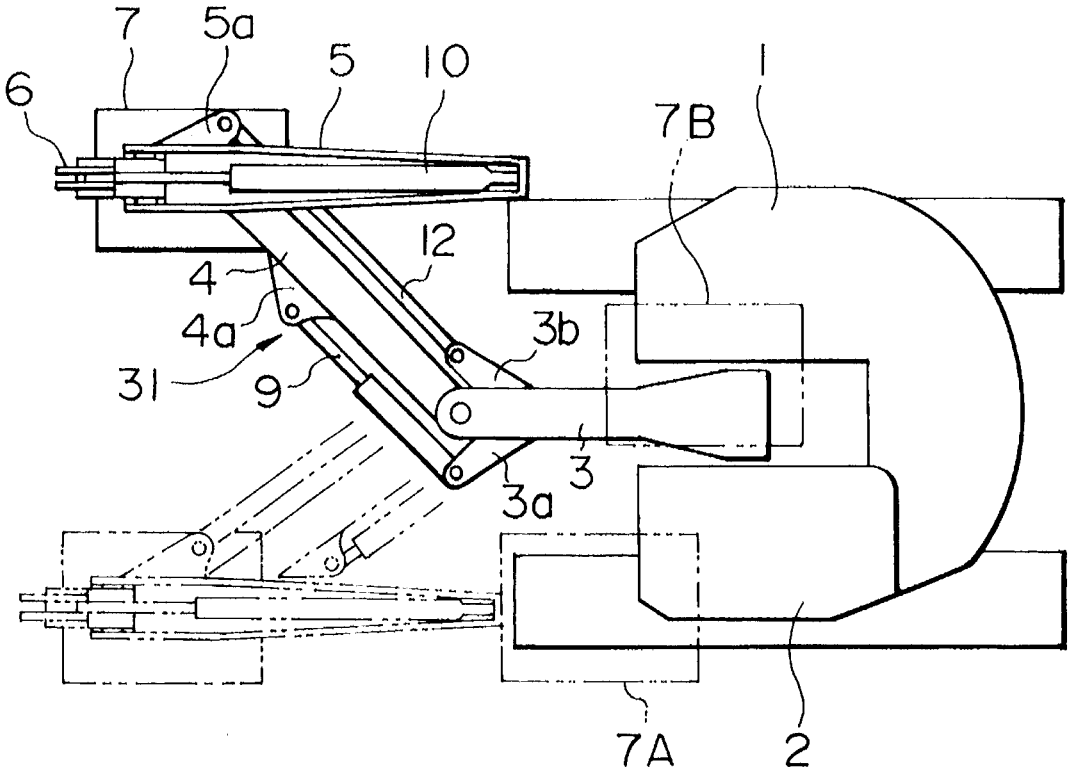
FIG. 3 is a plan view of the construction machine.

In FIGS. 1 to 3, denoted at reference numeral 1 is a body of a construction machine. Front working equipment 30 is mounted on a body 1 at a central portion of its front end, and a cab 2 is installed laterally of the front working equipment 30. The front working equipment 30 includes an offset boom 31 having a lower boom 3, an upper boom 4 and a cylinder stay 5, as well as an arm 6 and a bucket 7. The lower boom 3 is attached at its base end to the front end of the body 1 by a lateral pin for a vertical pivotal movement, so that the lower boom 3 is swung vertically with operation of a boom cylinder 8. The upper boom 4 is attached at its base end to a fore end of the lower boom 3 by a vertical pin for a lateral pivotal movement, so that the upper boom 4 is swung laterally with operation of an offset cylinder 9. The lateral swing of the upper boom 4 causes the offset boom 31 to offset sideways.

The boom cylinder 8 has opposite ends which are pivotally connected to the body 1 at the central portion of its front end and a back surface of the lower boom 3 at the fore end portion thereof, respectively. The offset cylinder 9 has opposite ends which are pivotally connected to a bracket **3*a* on a side surface of the lower boom 3 at the fore end portion thereof and a bracket 4*a* on a side surface of the upper boom 4** at the central portion thereof, respectively.

Figure 4A:
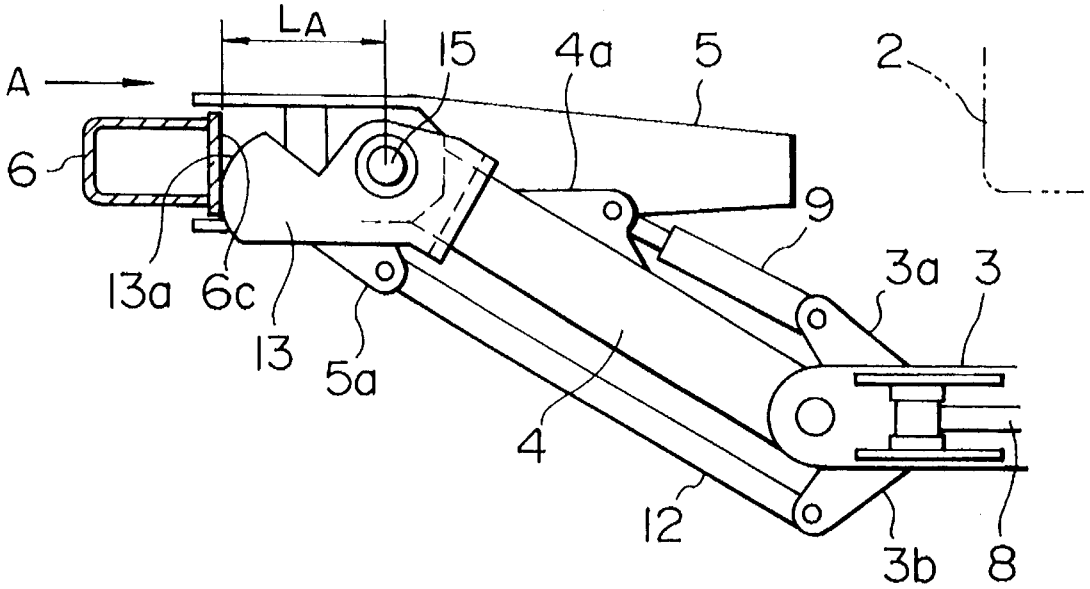
FIGS. 4(A) and 4(B) are views showing a principal part of the construction machine and are sectional views taken along line IVA—IVA in FIG. 1 and along line IVB—IVB in FIG. 2, respectively.
Figure 4B:
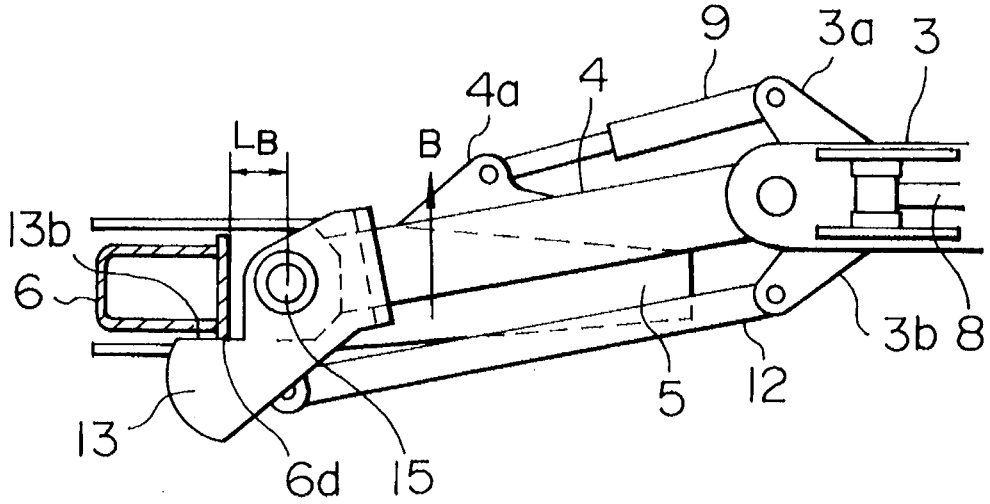

The cylinder stay 5 has a rear portion bifurcated in the vertical direction, and is attached to a fore end of the upper arm 4 by a vertical pin 15 (see FIGS. 4(A) and 4(B)) for a lateral pivotal movement. A fore end portion of the cylinder stay 5 is formed by a pair of left and right side plates in a bifurcated shape with a tail portion having a U-shaped cross-section and extending rearwardly from an upper fore end portion of the cylinder stay 5. As shown in FIG. 3, the cylinder stay 5 is also coupled to the lower boom 3 by a rod 12. The rod 12 has opposite ends which are pivotally connected to a bracket **3*b* on a side surface of the lower boom 3 at the fore end portion thereof and a bracket 5*a* on a side surface of the cylinder stay 5 at the fore end portion thereof, respectively. The rod 12, the lower boom 3, the upper boom 4 and the cylinder stay 5 cooperatively constitute a parallel link mechanism. Through this parallel link mechanism, when the upper boom 4 is swung laterally upon extension and contraction of the offset cylinder 9, the cylinder stay 5 is moved laterally while keeping a parallel relation to the lower boom 3**.

The arm 6 has a base end portion attached to the bifurcated fore end portion of the cylinder stay 5 by a Lateral pin for a vertical pivotal movement, so that the arm 6 is swung vertically with operation of an arm cylinder 10. The arm cylinder 10 has opposite ends which are pivotally connected to a rear end of the U-shaped tail portion of the cylinder stay 5 and a bracket 6*a* at a rear end of the arm 6, respectively. The bucket 7 has a box-like structure and serves as a working attachment adapted to perform digging and loading of earth and sand. The bucket 7 is attached to a fore end of the arm 6 by a lateral pin for a vertical pivotal movement, so that the bucket 7 is swung vertically with operation of a bucket cylinder 11. The bucket cylinder 11 has opposite ends which are pivotally connected to a bracket 6*b* at the rear end of the arm 6 on its back side and a link mechanism 7*a* provided on both the fore end portion of the arm 6 and the bucket 7, respectively.

Figure 5:
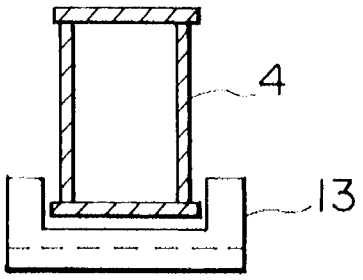
FIG. 5 is a sectional view taken along line V—V in FIG. 1.

On the lower surface of the cylinder stay 5 at its fore end portion, as shown in FIGS. 4(A) and 4(B), a cam-like stopper plate 13 is rotatably attached as a safety device for the front working equipment 30 by the aforesaid vertical pin 15. The stopper plate 13 has a rear end portion bifurcated as shown in FIG. 5 with a lower fore end portion of the upper boom 4 being fitted into a recess of the bifurcated rear end portion. The stopper plate 13 is thereby supported with respect to a lateral swing of the upper boom 4 such that the stopper plate 13 is swung in union with the upper boom 4. Further, as shown in FIGS. 4(A) and 4(B), the stopper plate 13 has an outer peripheral configuration comprising a first curved region 13*a* which functions as a first stopper means, and a second linear region 13*b* which functions as a second stopper means.

More specifically, the configuration and size of the first region 13*a* of the stopper plate 13 are set as follows. When a swing angle of the upper boom 4, i.e., an offset position of the offset boom 31, is within a risky range of possible interference between the bucket 7 and the cab 2 as indicated by reference character 7A in FIG. 3 upon the arm 6 being maximally folded, an inner belly portion 6*c* of the arm 6 folded in the direction of arrow A strikes against the first region 13*a* before the occurrence of such interference, as shown in FIGS. 4(A) and 1, whereby further folding of the arm 6 is mechanically limited. On the other hand, when the swing angle of the upper boom 4 is within a range in which the bucket 7 and the cab 2 will never interfere with each other even upon the arm 6 being maximally folded, the stopper plate 13 will not strike against the arm 6 until reaching a maximum folding angle thereof, as shown in FIGS. 4(B) and 2, whereby the arm 6 can be folded up to the maximum folding angle. Note that $L_A$ in FIGS. 4(A) and 1 stands for the distance between the pin 15 and the inner belly portion 6*c* of the arm 6 when the arm 6 is limited in its folding angle, while $L_B$ in FIGS. 4(B) and 2 stands for the distance between the pin 15 and the inner belly portion 6*c* of the arm 6 when the arm 6 is being maximally folded.

Further, the configuration and size of the second region 13*b* of the stopper plate 13 are set as follows. When the arm 6 is folded from a condition where the swing angle of the upper boom 4 is within a range in which the bucket 7 and the cab 2 will never interfere with each other, to a condition where the folding angle of the arm 6, i.e., a folded position thereof, comes within a risky range of possible interference between the bucket 7 and the cab 2 as indicated by reference character 7B in FIG. 3 upon the upper boom 4 being swung laterally toward the cab side, the second region 13*b* of the stopper plate 13 swung in the direction of arrow B together with the upper boom 4 strikes against a side portion 6*d* of the arm 6 before the occurrence of such interference, as shown in FIGS. 4(B) and 2, whereby relative rotation between the cylinder stay 5 and the upper boom 4 is mechanically restricted to limit a further swing of the upper boom 4. On the other hand, when the folding angle of the arm 6 is within a range in which the bucket 7 and the cab 2 will never interfere with each other even upon the upper boom 4 being swung laterally toward the cab side, the second region 13*b* of the stopper plate 13 swung in the direction of arrow B together with the upper boom 4 will not strike against the arm 6, whereby any lateral swing of the upper boom 4 is possible.

With this embodiment thus constructed, in the case of maximally lifting the lower boom 3 and maximally folding the arm 6 toward the cylinder stay 5 so as to attain a minimum turn radius of the front working equipment 30 with an intention of reducing a turn radius of the construction machine as much as possible, when the offset position of the offset boom 31, i.e., the swing angle of the upper boom 4, is within a range in which the bucket 7 will not hit the cab 2 over its lateral width, and hence there is no risk of possible interference between the bucket 7 and the cab 2, the arm 6 can be maximally folded to provide the minimum turn radius as usual, as shown in FIGS. 4(B) and 2. On the other hand, when the swing angle of the upper boom 4 is within a risky range in which a part or the whole of the width of the bucket 7 overlaps with the cab 2 and the bucket 7 would thus interfere with the cab 2 as indicated by reference character 7A in FIG. 3, further folding of the arm 6 from that condition causes the inner belly portion 6*c* of the arm 6 to strike against the first region 13*a* of the stopper plate 13 as shown in FIGS. 4(A) and 1, so that such further folding of the arm 6 is mechanically limited to prevent the bucket 7 from hitting on a top portion of the cab 2.

Further, when the upper boom 4 is swung toward the cab 2 from a condition that the arm 6 is so greatly folded as to locate the bucket 7 laterally of the cab 2 as indicated by reference character 7B in FIG. 3, the second region 13*b* of the stopper plate 13 strikes against the side portion 6*d* of the arm 6 as shown in FIG. 4(B), so that relative rotation between the cylinder stay 5 and the upper boom 4 is mechanically restricted to limit a further swing of the upper boom 4, with the result that the bucket 7 can be prevented from hitting the flank of the cab 2.

With this embodiment, therefore, it is possible to swing the upper boom 4 even to the same side as the cab for securing a wide area of working, while preventing the bucket 7 from hitting the cab 2 when the bucket 7 is within a risky range of possible interference with the cab, thereby ensuring a high degree of safety.

Other embodiments of the present invention will be described below with reference to FIGS. 6 to 9. These embodiments adopt, as safety means, different construction for the first and second stopper means.

Figure 6:
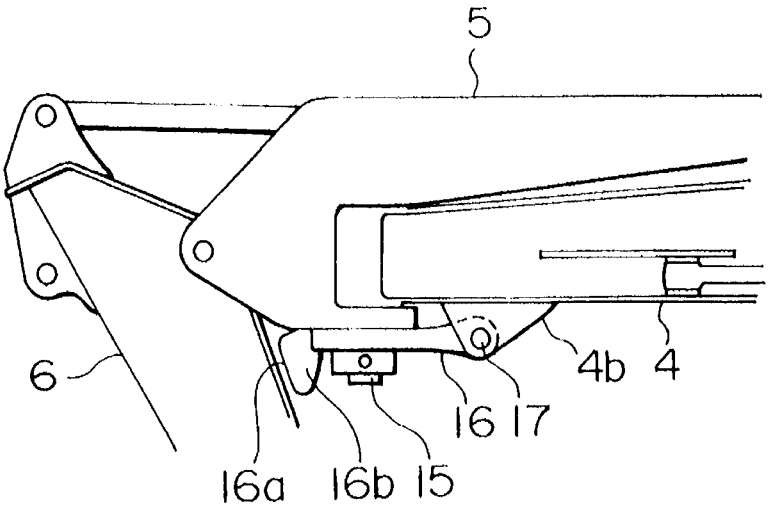
FIG. 6 is a side view of a safety device section of an offset boom type construction machine according to a second embodiment of the present invention.

FIG. 6 shows a second embodiment of the present invention in which a stopper plate 16 is rotatably attached to the lower surface of the cylinder stay 5 by the pin 15, and has a rear end portion coupled by a lateral pin 17 to a bracket 4*b* provided on the fore end portion of the upper boom 4 so that the stopper plate 16 may be swung in union with a lateral swing of the upper boom 4. A front end portion of the stopper plate 16 has a three-dimensional configuration and size such that it comprises a first region 16*a* striking against the inner belly portion of the arm 6 to limit the folding of the arm 6, and a second region 16*b* striking against the side portion of the arm 6 to limit the swing of the upper boom 4. These first and second regions 16*a*, 16*b* are arranged essentially equivalently to the first and second regions 13*a*, 13*b* of the stopper plate 13 in the first embodiment. The stopper plate 16 in this embodiment also functions as the first and second stopper means in essentially the same manner as the stopper plate 13 in the first embodiment, and thus provides similar operating advantages to the first embodiment.

Figure 7:
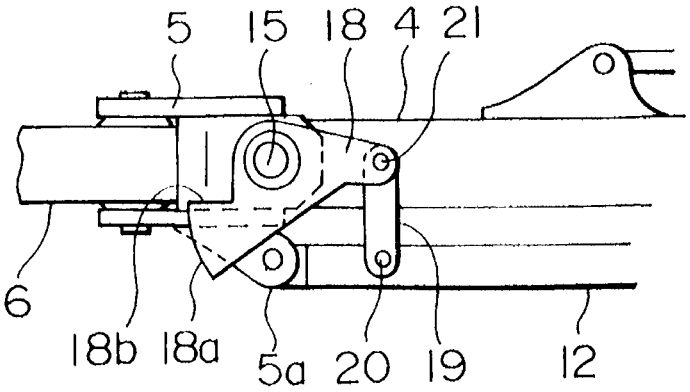
FIG. 7 is a bottom view of a safety device section of an offset boom type construction machine according to a third embodiment of the present invention.

FIG. 7 shows a third embodiment of the present invention in which a stopper plate 18 is rotatably attached to the lower surface of the cylinder stay 5 by the pin 15, and has a rear end portion coupled to the rod 12 by pins 20 and 21 via a link 19. Since the rod 12 is moved in union with the upper boom 4 as mentioned before, such link coupling of the rear end portion of the stopper plate 18 to the rod 12 permits the stopper plate 18 to move in union with the upper boom 4. Additionally, the stopper plate 18 has first and second regions 18*a*, 18*b* arranged similarly to the first and second regions 13*a*, 13*b* of the stopper plate 13 in the first embodiment. The stopper plate 18 thus arranged also functions as the first and second stopper means in the same manner as the stopper plate 13 in the first embodiment, and thus provides similar operating advantages to the first embodiment.

Figure 8:
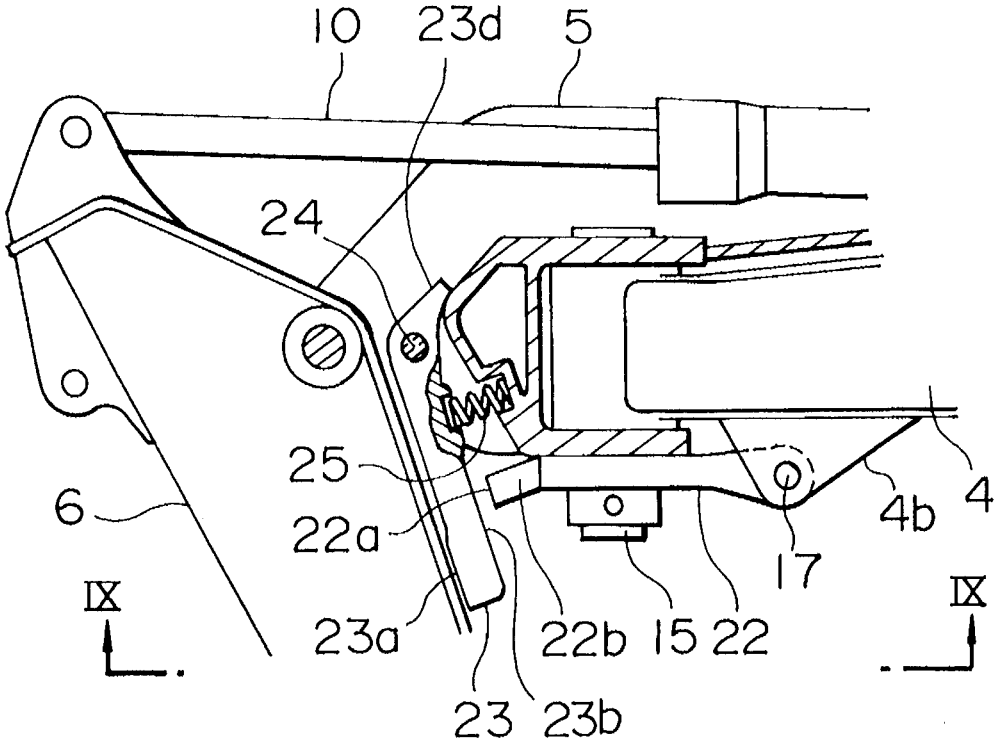
FIG. 8 is a side view, partially sectioned, of a safety device section of an offset boom type construction machine according to a fourth embodiment of the present invention.
Figure 9:
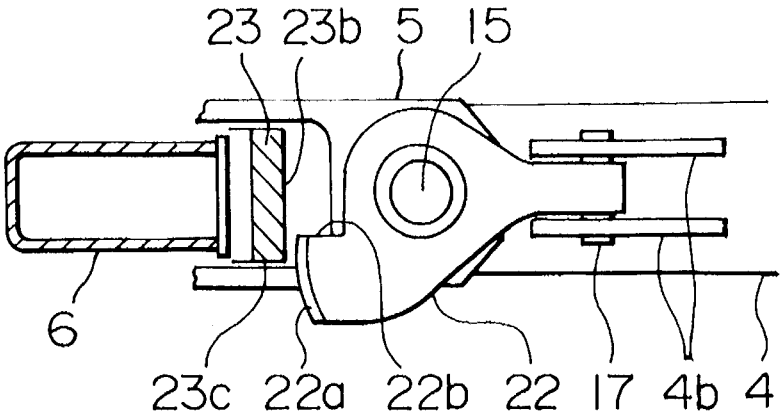
FIG. 9 is a sectional view taken along line IX—IX in FIG. 8.

FIGS. 8 and 9 show a fourth embodiment of the present invention. In this embodiment, a stopper plate 22 has the same structure as the stopper 16 in the second embodiment, but a link 23 is interposed between the bifurcated fore end portion of the cylinder stay 5 and the arm 6. The link 23 has an upper end portion pivotally attached by a lateral pin 24 to the cylinder stay 5 in a swingable manner to-and-fro thereof, and a lower end portion comprising a region 23*a* striking against the inner belly portion of the arm 6, a region 23*b* striking against a first region 22*a* of the stopper plate 22, and a region 23*c* striking against a second region 22*b* of the stopper plate 22. Also, a spring 25 is disposed between an intermediate portion of the link 23 and the bifurcated portion of the cylinder stay 5 for biasing the link 23 in a direction away from the stopper plate 22. Further, the upper end portion of the link 23 includes a stopper 23*d* striking against the bifurcated portion of the cylinder stay 5 to limit a forward swing of the link 23 within a certain angle.

When the offset position of the offset boom 31 is within a risky range of possible interference between the bucket 7 and the cab 2 upon the arm 6 being maximally folded, the inner belly portion of the arm 6 strikes against the region 23*a* of the link 23 and the spring 25 is compressed by being pushed by the link 23 at the beginning of the process of folding the arm 6, following which the region 23*b* of the link 23 strikes against the first region 22*a* of the stopper plate 22, whereby further folding of the arm 6 is mechanically limited to prevent interference between the bucket 7 and the cab 2. Accordingly, the first region 22*a* of the stopper plate 22 and the regions 23*a*, 23*b* of the link 23 cooperatively constitute the first stopper means adapted to limit the folding of the arm.

Meanwhile, when the arm 6 is folded from a condition where the swing angle of the upper boom 4 is within a range in which the bucket 7 and the cab 2 will never interfere with each other, to a condition where the folding angle of the arm 6, i.e., the folded position thereof, comes within a risky range of possible interference between the bucket 7 and the cab 2 upon the upper boom 4 being further swung laterally toward the cab side, the second region 22*b* of the stopper plate 22 strikes against the lateral surface 23*c* of the link 23, whereby relative rotation between the cylinder stay 5 and the upper boom 4 is mechanically restricted to limit further swing of the upper boom 4. On the other hand, when the folding angle of the arm 6 is within a range in which the bucket 7 and the cab 2 will never interfere with each other even upon the upper boom 4 being further swung laterally toward the cab side, the link 23 is pushed by the spring 25 to depart from the stopper plate 22 and the second region 22*b* of the stopper plate 22 is positioned not to strike against the link region 23*c*, so that lateral swing of the upper boom 4 is not limited. In this way, the second region 22*b* of the stopper plate 22 and the region 23*c* of the link 23 cooperatively constitute the second stopper means adapted to mechanically limit the swing of the upper boom 4 toward the cab side, because the former strikes against the latter for mechanically restricting relative rotation between the cylinder stay 5 and the upper boom 4.

Accordingly, this embodiment can also provide similar operating advantages to the first embodiment.

Still other embodiments of the present invention will be described below with reference to FIGS. 10 to 14. These embodiments also adopt, as safety means, different constructions for the first and second stopper means.

Figure 10:
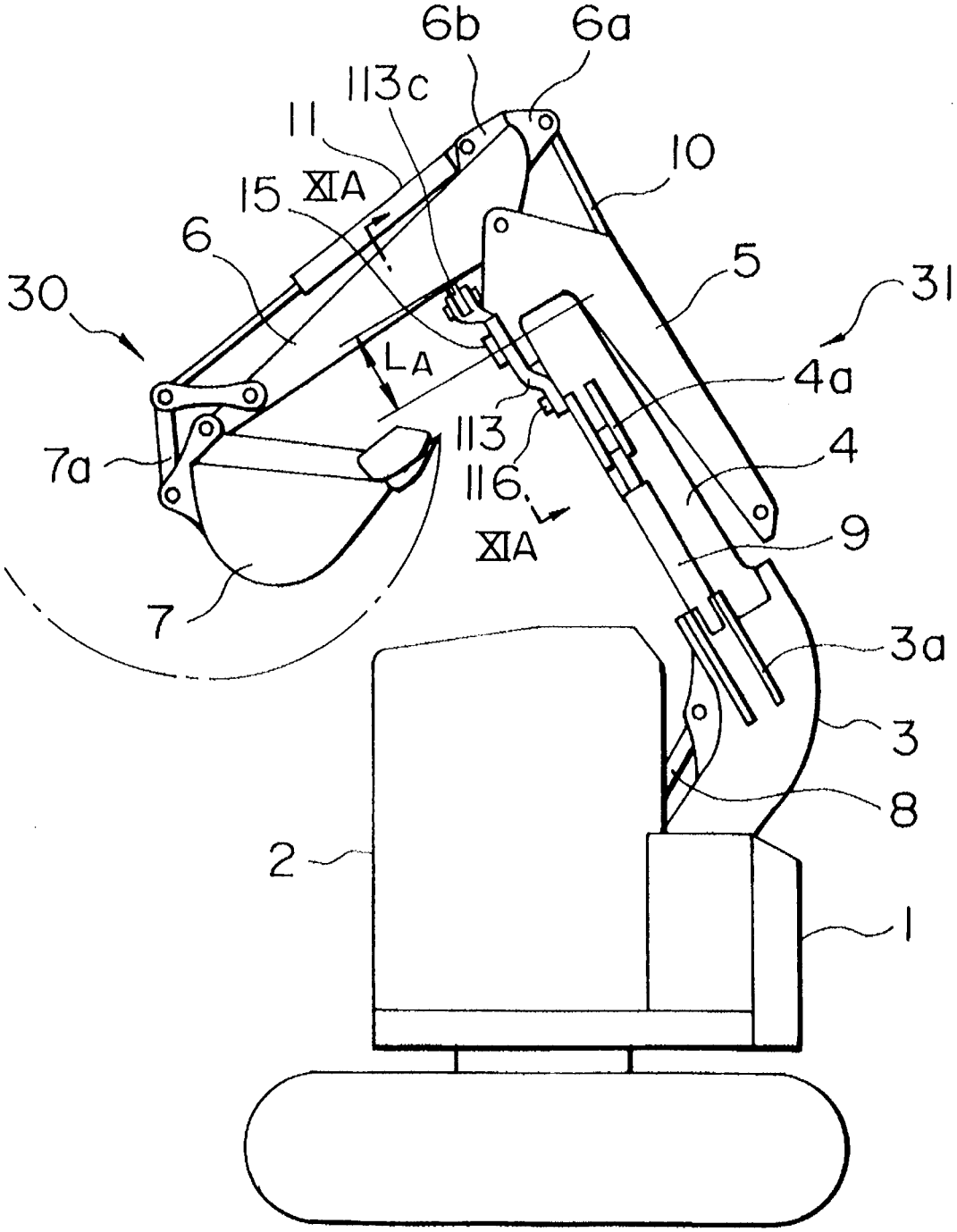
FIG. 10 is a side view of an offset boom type construction machine according to a fifth embodiment of the present invention.
Figure 11A:
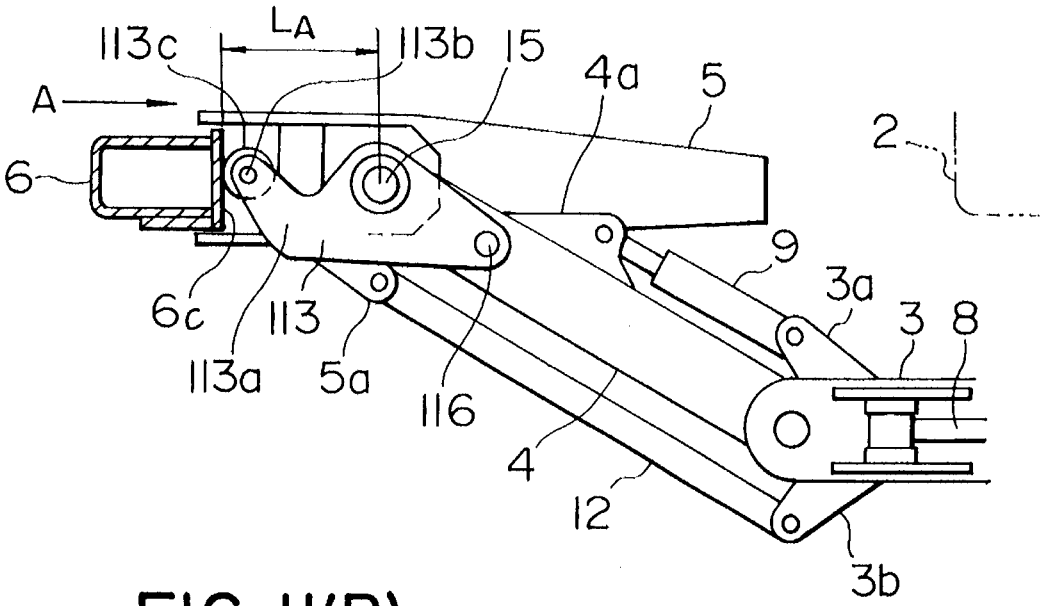
FIGS. 11(A) and 11(B) are views showing a principal part of the construction machine of FIG. 10 and are a sectional view taken along line XIA—XIA in FIG. 10 and a sectional view similar to FIG. 4(B), respectively.
Figure 11B:
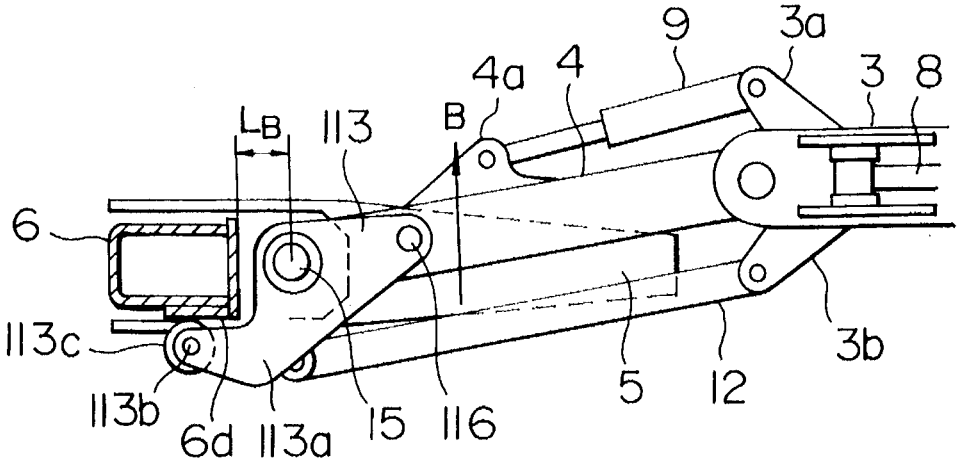

FIGS. 10, 11(A) and 11(B) show a fifth embodiment of the present invention in which a stopper plate 113 is attached, as the safety device for the front working equipment 30, to the lower surface of the cylinder stay 5 at its fore end portion by the aforesaid pin 15 and another pin 116 in a manner so that the stopper plate 113 is rotatable together with the upper boom 4. As seen from FIGS. 11(A) and 11(B), the stopper plate 113 has a projection 113*a* formed to be offset with respect to the upper boom 4, and a rolling member 113*c* in the form of a roller is rotatably attached to a fore end of the projection 113*a* by a pin 113*b*.

The rolling member 113*c* and the projection 113*a* of the stopper plate 113 function as the first stopper means for mechanically restricting the folding of the arm 6. To put it in more detail, when the swing angle of the upper boom 4, i.e., the offset position of the offset boom 31, is within a risky range of possible interference between the bucket 7 and the cab 2 upon the arm 6 being maximally folded as indicated by reference character 7A in FIG. 3, the inner belly portion 6*c* of the arm 6 folded in the direction of arrow A strikes against the rolling member 113*c* before the occurrence of such interference, as shown in FIGS. 10 and 11(A), whereby further folding of the arm 6 is mechanically limited. In addition, the configuration and size of the rolling member 113*c* and the projection 113*a* of the stopper plate 113 are set such that when the swing angle of the upper boom 4 is within a range in which the bucket 7 and the cab 2 will never interfere with each other even upon the arm 6 being maximally folded, the rolling member 113*c* will not strike against the arm 6 until reaching the maximum folding angle thereof, as shown in FIG. 11(B), whereby the arm 6 can be folded up to the maximum folding angle. Note that LA in FIGS. 10 and 11(A) stands for the distance between the pin 15 and the inner belly portion 6*c* of the arm 6 when the arm 6 is limited in its folding angle, while LB in FIG. 11(B) stands for the distance between the pin 15 and the inner belly portion 6*c* of the arm 6 when the arm 6 is maximally folded.

Further, the rolling member 113*c* and the projection 113*a* of the stopper plate 113 also function as the second stopper means for mechanically restricting the swing of the upper boom 4. To put it in more detail, when the arm 6 is folded from a condition where the swing angle of the upper boom 4 is within a range in which the bucket 7 and the cab 2 will never interfere with each other to a condition where the folding angle of the arm 6, i.e., the folded position thereof, comes within a risky range of possible interference between the bucket 7 and the cab 2 upon the upper boom 4 being further swung laterally toward the cab side as indicated by reference character 7B in FIG. 3, the rolling member 113*c* strikes against the side portion 6*d* of the arm 6 before the occurrence of such interference, as shown in FIG. 11(B), whereby relative rotation between the cylinder stay 5 and the upper boom 4 is mechanically restricted to limit further swing of the upper boom 4. In addition, the configuration and size of the rolling member 113*c* and the projection 113*a* of the stopper plate 113 are set such that when the folding angle of the arm 6 is within a range in which the bucket 7 and the cab 2 will never interfere with each other even upon the upper boom 4 being further swung laterally toward the cab side, the rolling member 113*c* swung in the direction of arrow B together with the upper boom 4 will not strike against the arm 6, whereby lateral swing of the upper boom 4 is not limited.

With this embodiment thus constructed, in the case of maximally lifting the lower boom 3 and maximally folding the arm 6 toward the operator so as to attain the minimum turn radius of the front working equipment 30 with an intention of reducing the turn radius of the construction machine as much as possible, when the offset position of the offset boom 31, i.e., the swing angle of the upper boom 4, is within a range in which the bucket 7 will not hit the cab 2 over its lateral width, and hence there is no risk of possible interference between the bucket 7 and the cab 2, the arm 6 can be maximally folded to provide the minimum turn radius as usual, as shown in FIG. 11(B) and FIG. 2 explained before. On the other hand, when the swing angle of the upper boom 4 is within a risky range in which a part or the whole of the width of the bucket 7 overlaps with the cab 2 and the bucket 7 would interfere with the cab 2 as indicated by reference character 7A in FIG. 3, further folding of the arm 6 from that condition causes the inner belly portion 6*c* of the arm 6 to strike against the rolling member 113*c* now serving as the first stopper means as shown in FIGS. 10 and 11(A), so that such further folding of the arm 6 is mechanically limited to prevent the bucket 7 from hitting the top portion of the cab 2.

Further, when the upper boom 4 is swung toward the cab 2 from a condition where the arm 6 is so greatly folded as to locate the bucket 7 laterally of the cab 2 as indicated by reference character 7B in FIG. 3, the rolling member 113*c* now serving as the second stopper means strikes against the side portion 6*d* of the arm 6 as shown in FIG. 11(B), so that relative rotation between the cylinder stay 5 and the upper boom 4 is mechanically restricted to limit further swing of the upper boom 4, with the result that the bucket 7 can be prevented from hitting the flank of the cab 2.

With this embodiment, therefore, it is even possible to swing the upper boom 4 to the same side as the cab for securing a wide area of working, and also to prevent the bucket 7 from hitting the cab 2 when the bucket 7 is within a risky range of possible interference with the cab, thereby ensuring a high degree of safety, similarly to the first embodiment.

Additionally, with this embodiment, since the rolling member 113*c* is provided at the fore end of the projection 113*a* of the stopper plate 113 as stated before, the rolling member 113*c* is caused to roll along the inner belly portion 6*c* of the arm 6 when the upper boom 4 is swung laterally the rolling member 113*c* now serving as the first stopper means is kept abutted against the inner belly portion 6*c* of the arm 6, as shown in FIG. 11(A). Therefore, the mutually abutting portions develop little friction between them, wear off to a quite small extent, and thus will not be scraped off. As a result, the service life is prolonged and the operation is smoothed.

Moreover, since the rolling member 113*c* is caused to roll along the side portion 6*d* of the arm 6 when the arm 6 is swung to-and-fro while the rolling member 113*c* now serving as the second stopper means is kept abutted against the side portion 6*d* of the arm 6 as shown in FIG. 11(B), the mutually abutting portions also develop little friction between them, wear off to a quite small extent, and thus will not be scraped off. As a result, the service life is prolonged and the operation is smoothed.

In particular, when the mutually abutting portions between the rolling member 113*c* and the arm 6 are operated to shift from the inner belly portion 6*c* to the side portion 6*d* of the arm, or vice versa, i.e., when the mutually abutting portions between the rolling member 113*c* and the arm 6 are operated to shift from the side portion 6*d* to the inner belly portion 6*c* of the arm, the rolling member 113*c* rides over a boundary corner between the inner belly portion 6*c* and the side portion 6*d* of the arm, while continuing the rolling. Consequently, the corner is less worn and the operation is smoothed.

Figure 12:
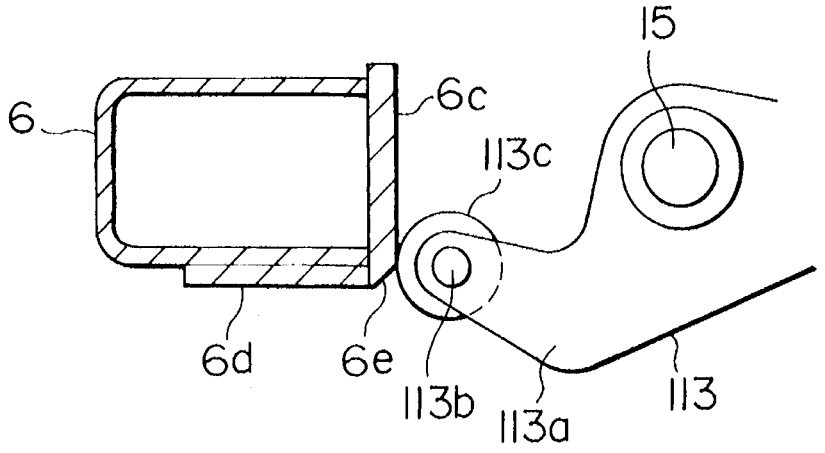
FIGS. 12 and 13 are views showing a principal part, different in form, of an offset boom type construction machine according to a sixth embodiment of the present invention.
Figure 13:
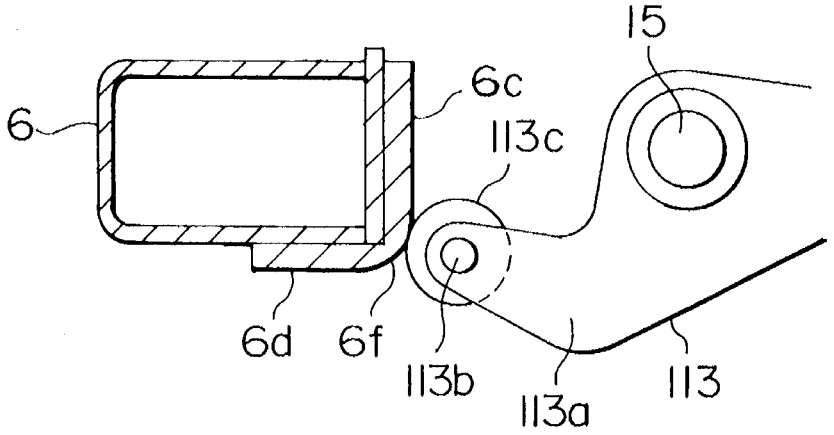

FIGS. 12 and 13 show different forms of a sixth embodiment of the present invention. In this embodiment, the corner of the arm is chamfered or formed into a smooth curved surface. More specifically, in FIG. 12, a chamfered surface 6*e* is formed at the boundary corner between the inner belly portion 6*c* and the side portion 6*d* of the arm 6. In FIG. 13, a curved surface 6*f* is formed at the boundary corner between the inner belly portion 6*c* and the side portion 6*d* of the arm 6.

With these forms of this embodiment, the operation of the rolling member 113*c* riding over the boundary corner between the inner belly portion 6*c* and the side portion 6*d* of the arm 6 is further smoothed.

Figure 14:
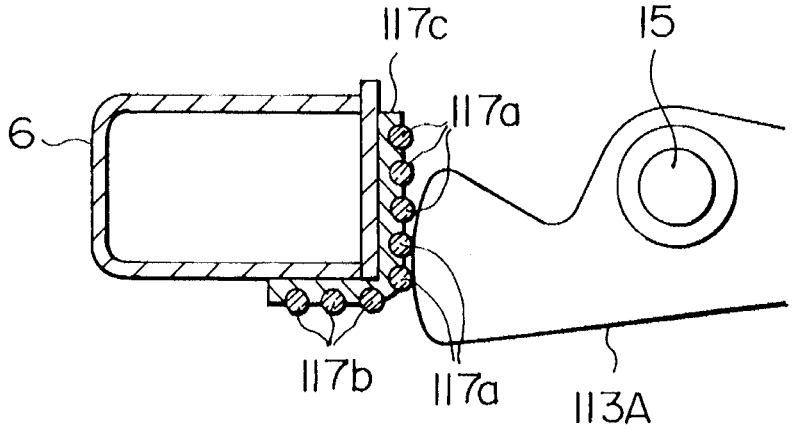
FIG. 14 is a view showing a principal part of an offset boom type construction machine according to a seventh embodiment of the present invention.

A seventh embodiment of the present invention is shown in FIG. 14. While the single rolling member is used as the rolling means in the above embodiments, the rolling member may be plural in number and may have any other shape such as spherical, needle-like or conical, so long as it can roll over the arm surfaces. Also, while the rolling member is attached to the side of the stopper plate 113 in the above embodiments, it may be provided on the side of the arm 6. This embodiment represents a modification in this respect.

More specifically, in FIG. 4, a liner plate 117*c* is attached to and over the inner belly portion and the side portion of the arm 6. Then, a plurality of spherical or needle-like rolling members 117*a* are buried as first rolling means in the region of the liner plate 117*c* corresponding to the inner belly portion of the arm 6, and a plurality of spherical or needle-like rolling members 117*b* are buried as second rolling means in the region of the liner plate 117*c* corresponding to the side portion of the arm 6. This embodiment can also provide similar operating advantages as far the above embodiments.

It should be understood that while the stopper plate is supported at the fore end of the upper boom 4 by being rotatably attached to the fore end portion of the cylinder stay 5 by the pin 15 in the above embodiments, the stopper plate may be mounted in any other suitable manner such as by welding or being screwed to the fore end portion of the upper boom 4, because it is only required to move in union with the swing of the upper boom 4.

The risky range of possible interference between the bucket 7 and the cab 2 may be set with some allowance relative to the margin.

Further, the above embodiments are arranged such that when the swing angle of the upper boom 4 is within a range in which the bucket 7 will never interfere with the cab 2 upon the arm 6 being folded, the first stopper means will not strike against the arm 6 until the arm 6 reaches the maximum folding angle so as not to mechanically limit the folding of the arm 6. In this case, however, the folding of the arm 6 may be limited within a particular range so as to prevent the arm 6 from being folded up to the maximum folding angle, taking into account interference between the bucket 7 and members other than the cab 2 for example, interference between the bucket 7 and a crawler).

Additionally, although the above explanation is made by referring to the front working equipment provided with a bucket, the present invention is also similarly applicable to front working equipment provided with any other working attachment in place of the bucket.

INDUSTRIAL APPLICABILITY (1) According to the present invention, it is possible to swing the upper boom even to the same side as the cab for securing a wide area of working, and also prevent the working attachment from hitting the cab when the working attachment is within a risky range of possible interference with the cab, thereby ensuring a high degree of safety.

(2) The mutually abutting portions between the first and second stopper means and the arm are less worn, which results in prolonged service life. Particularly, the boundary (corner) between the inner belly portion and the side portion of the arm, as well as the corners of the stopper, are less worn.

(3) The operation is smoothed in swinging the upper boom laterally when the inner belly portion of the arm is kept abutted against the first stopper means.

(4) The operation is smoothed in swinging the arm to-and-fro when the side portion of the arm is kept abutted against the second stopper means.

(5) The operation is smoothed in the above (3) and (4), particularly when the abutment portions of the first and second stopper means ride over the boundary (corner) between the inner belly portion and the side portion of the arm.

We claim:

1. An offset boom construction machine comprising a front working equipment and a cab provided on a body of said construction machine, said front working equipment including: an offset boom having a lower boom attached to said body for a vertical pivotal movement, an upper boom attached to a fore end of said lower boom for a lateral pivotal movement, and a cylinder stay attached to a fore end of said upper boom for a lateral pivotal movement; an arm attached to said cylinder stay for a vertical pivotal movement; said boom further having a rod connecting said lower boom and said cylinder stay for offsetting said cylinder stay and thus the arm upon a lateral swing of said upper boom; and a working attachment attached to a fore end of said arm, wherein:

said construction machine further comprises a stopper device attached to underside portions of said upper boom and said cylinder stay for movement with the lateral pivotal movement of the upper boom, said stopper device including abutment means for abutting against said arm to prevent further folding of said arm when an offset position of said offset boom is substantially within a range where there is a potential for interference between said working attachment and said cab to occur upon said arm being folded, and for abutting against said arm to prevent further lateral swing of said upper boom toward said cab when a folded position of said arm is substantially within a range where there is a potential for the interference to occur upon said upper boom being swung laterally toward said cab.

2. The offset boom construction machine according to claim 1, wherein said stopper device has a stopper plate, said stopper plate having an outer peripheral configuration including, as said abutment means, a first region positioned to strike against an inner belly portion of said arm when said arm is folded, and a second region positioned to strike against a side portion of said arm when said upper boom is swung toward said cab under a condition of said arm being folded.

3. The offset boom construction machine according to claim 2, wherein said cylinder stay is connected by a pin for the lateral pivotal movement to said underside of said upper boom at the fore end thereof, and said stopper plate is attached to a lower surface of said cylinder stay by said pin.

4. The offset boom construction machine according to claim 1, wherein said stopper device has a stopper plate, and rolling means provided as said abutment means on said stopper plate and being capable of rolling in response to lateral and back-and-forth relative movement under a condition of the stopper plate abutting against the arm.

5. The offset boom construction machine according to claim 4, wherein a chamfered surface is provided at a boundary corner between the inner belly portion and the side portion of said arm against which said rolling means are abutted.

6. The offset boom construction machine according to claim 4, wherein a curved surface is provided at a boundary corner between the inner belly portion and the side portion of said arm against which said rolling means are abutted.

7. The offset boom construction machine according to claim 1, wherein said arm includes first rolling means provided on an inner belly portion of said arm and being capable of rolling in response to lateral relative movement under a condition of the stopper plate abutting against the arm belly portion and second rolling means provided on a side portion of said arm and being capable of rolling in response to back-and-forth relative movement under a condition of the stopper plate abutting against the arm side portion.

8. The offset boom construction machine according to claim 1, wherein said stopper device further has a link interposed between said abutment means and said arm, and the abutment means of said stopper device is adapted to abut against the arm through said link.

9. An offset boom construction machine comprising a front working equipment and a cab provided on a body of said construction machine, said front working equipment including: an offset boom having a lower boom attached to said machine body for a vertical pivotal movement, an upper boom attached to a fore end of said lower boom for a lateral pivotal movement, and a cylinder stay attached to a fore end of said upper boom for a lateral pivotal movement, said offset boom being capable of offsetting upon a lateral swing of said upper boom; an arm attached to said cylinder stay for a vertical pivotal movement further having a rod connecting said lower boom and said cylinder stay for offsetting said cylinder stay and thus the arm in parallel with said lower boom; and a working attachment attached to a fore end of said arm, wherein:

said construction machine further comprises a stopper device attached to an underside portion of said upper boom at said fore end thereof for movement in union therewith upon lateral pivotal movement of the upper boom, said stopper device including a first abutment portion for abutting against said arm to prevent further folding of said arm when an offset position of said arm is substantially within a range where there is a potential for interference between said working attachment and said cab to occur upon said arm being folded, and a second abutment portion for abutting against said arm to prevent further lateral swing of said upper boom toward said cab when a folded position of said arm is within a range where there is a potential for the interference to occur upon said upper boom being swung laterally toward said cab.

10. The offset boom construction machine according to claim 1, wherein said abutment means directly abuts against said arm to prevent occurrence of the interference between said working attachment and said cab when said arm is being folded and when said upper boom is being swung laterally towards said cab.

11. An offset boom construction machine comprising a front working equipment and a cab provided on a body of said construction machine, said front working equipment including: an offset boom having a lower boom attached to said body for a vertical pivotal movement, an upper boom attached to a fore end of said lower boom for a lateral pivotal movement, and a cylinder stay attached to a fore end of said upper boom for a lateral pivotal movement; an arm attached to said cylinder stay for a vertical pivotal movement; said boom further having a rod connecting said lower boom and said cylinder stay for offsetting said cylinder stay and thus the arm upon a lateral swing of said upper boom; and a working attachment attached to a fore end of said arm, wherein:

said construction machine further comprising a stopper device disposed at underside portions of said upper boom and said cylinder stay that is attached to said cylinder stay and that engages structure of said upper boom, said stopper device including an abutment portion for abutting against said arm to prevent further folding of said arm when an offset position of said offset boom is substantially within a range where there is a potential for interference between said working attachment and said cab to occur upon said arm being folded, and for abutting against said arm to prevent further lateral swing of said upper boom toward said cab when a folded position of said arm is substantially within a range where there is a potential for the interference to occur upon said upper boom being swung laterally toward said cab.

12. The offset boom construction machine according to claim 11, wherein said stopper device has a stopper plate having said abutment portion at one end thereof and an end portion opposite said abutment portion that engages said upper boom structure.

13. The offset boom construction machine according to claim 12, wherein said end portion of said stopper plate has upstanding edges and said upper boom structure includes sides of said upper boom, wherein said upstanding edges engage said sides of said upper boom respectively.

* * * * *